United States Patent [19]

Carles et al.

[11] Patent Number: 4,462,864

[45] Date of Patent: Jul. 31, 1984

[54] PROCESS FOR THE DELIGNIFICATION OF UNBLEACHED CHEMICAL PULP

[75] Inventors: Jacques Carles, Saint Graudens; Henri Lemoyne, Montmedy, both of France

[73] Assignee: Groupement Europeen de la Cellulose, Paris, France

[21] Appl. No.: 368,142

[22] Filed: Apr. 14, 1982

Related U.S. Application Data

[63] Continuation of Ser. No. 139,198, Apr. 11, 1980, abandoned.

[30] Foreign Application Priority Data

Apr. 17, 1979 [FR] France ..... 79 09642
Mar. 31, 1980 [FR] France ..... 80 07170

[51] Int. Cl.[3] ..... D21C 9/16

[52] U.S. Cl. ..... 162/56; 162/41; 162/78

[58] Field of Search ..... 162/78, 56, 29, 41

[56] References Cited

U.S. PATENT DOCUMENTS 3,867,246 2/1975 Hebbel et al. ..... 162/78
4,160,693 7/1979 Lindahl et al. ..... 162/78
4,244,778 1/1981 Lindahl et al. ..... 162/78

*Primary Examiner*—William F. Smith
*Attorney, Agent, or Firm*—Weingarten, Schurgin, Gagnebin & Hayes

[57] ABSTRACT

The invention relates to a process for the delignification of unbleached chemical pulp, comprising the following stages:

(a) oxidation of the unbleached pulp with a peroxide, in an alkaline medium with a % ratio of peroxide/pulp with respect to the Kappa index of said pulp which may vary between 0.01 and 0.1 and a pH kept at between 9 and 12, the said oxidation stage being followed by (b) mechanical pressing of the oxidized pulp, with recycling of the extraction effluents from the pressing stage,
partly above the oxidation stage,
partly below the oxidation stage, with a view to ensure the prior dilution of the pulp oxidized before the pressing,
and if necessary partly towards the wash of the unbleached pulp.

Advantages: A reduction in the quantities of reagents to be used, a saving of heat energy and a reduction of the pollution.

12 Claims, 3 Drawing Figures

PROCESS FOR THE DELIGNIFICATION OF UNBLEACHED CHEMICAL PULP

Figure 1:
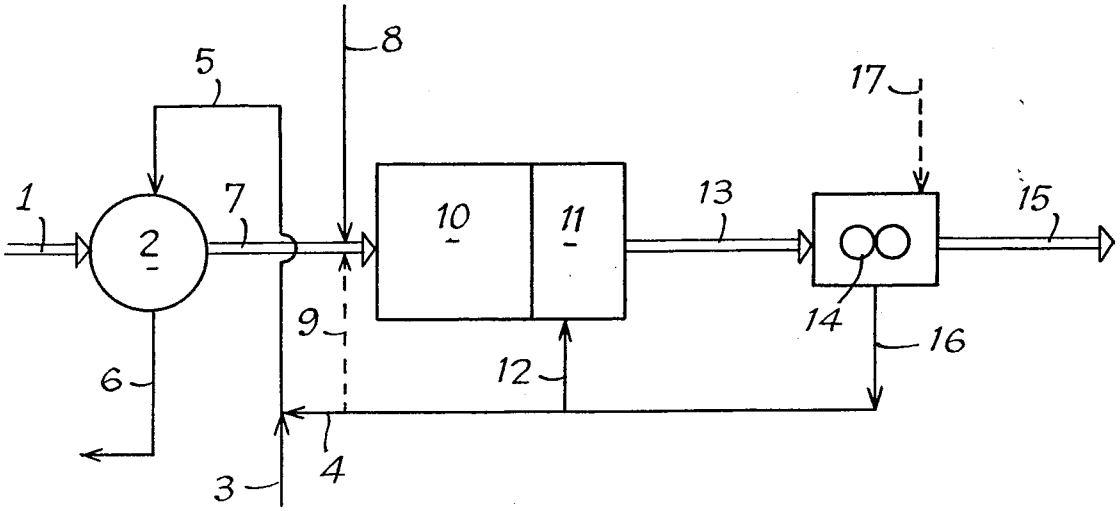

This is a continuation of application Ser. No. 139,198, filed Apr. 11, 1980, abandoned.

The production of so-called "chemical" pulp, consists of two main phases, i.e.

a cooking phase for the lignocellulosic materials using chemical reagents such as caustic soda, calcium bisulphite, a sodium sulphide-caustic soda mixture, etc . . . , which phase is intended to dissolve most of the lignin and to release the cellulose fibres, in order to obtain an unbleached pulp and residual cooking liquors, which are generally recovered and burnt;

a bleaching phase for bleaching the unbleached pulp, normally consisting of several stages of treatment to whiten the pulp and to eliminate the residual lignin left in the unbleached pulp after the cooking. The first bleaching stage consists, in the conventional way, in a treatment using a chlorinated reagent such as chlorine dioxide, sodium hypochlorite . . . . This type of treatment however shows a number of disadvantages; in particular, it gives effluents polluted by corrosive chlorides which it is impossible to recycle into the system of recovery of the chemical products used for making the wood into pulp (cooking phase), due to the high risks created by the presence of the chlorides.

In order to limit the pollution, a bleaching process was recently proposed which consists in treating the unbleached pulp with oxygen under pressure in an alkaline medium. This latest process leads to an effluent which is compatible with the recovery system of the cooking unit, and which is removed by combustion. Such a process necessitates high investments.

Also, recently, peroxides have been proposed as bleaching agents, also leading to a recoverable effluent.

However, the mechanism of the bleaching action when using peroxides is entirely different from the mechanisms of the bleaching agents indicated hereinabove.

The peroxides are bleaching agents known as preservative of lignin, which means that they permit to obtain a whitening of the pulp without reducing the weight of the material by oxidizing the chromophoric groups attached to the large molecules of lignin, but they do not attack the main structure of the actual lignin.

Consequently, peroxides are preferably used for bleaching pulps (mechanical pulps, thermo-mechanical pulps, semi-chemical pulps) known as pulps with a high lignin content or with a high yield (yield>65%) which are not meant to be dilignified, but rather bleached without any reduction in the weight of the material.

Now, the inventors have discovered that it was possible to produce a delignification of unbleached chemical pulps (i.e. pulps with a low yield (<65%) and low lignin content, using peroxides (hydrogen peroxide, sodium peroxide, and other alkaline peroxides) of which the delignifying properties are not known to this day—by adapting the quantity of peroxide used to the lignin content of the unbleached pulp to be treated,

- by conducting the peroxide treatment in alkaline medium,
- by combining the said treatment with a high density mechanical pressing,
- and by recycling the effluents of said pressing upstream and downstream the said peroxide treatment, before the said mechanical pressing, It is therefore the object of the present invention to propose a process for the delignification of so-called "chemical" unbleached pulp consisting of the following stages:

(a) oxidation of the unbleached pulp by a peroxide, in an alkaline medium, followed by (b) mechanical pressing of the oxidized pulp, with recycling of the extraction effluents from the pressing stage, partly upstream the oxidation stage partly downstream the said oxidation stage in order to ensure a prior dilution of the pulp oxidized before the pressing,—and if necessary partly towards the washing of the unbleached pulp, and/or at recovery.

In stage (a) of oxidation of the unbleached pulp, the quantity of peroxide used is adapted to the lignin content of the pulp to be treated so as to have a % ratio peroxide/pulp with respect to the Kappa number of the pulp to be treated, of between 0.01 and 0.01 (in other words, the peroxide/pulp weight ratio given in % and divided by the Kappa number of the pulp should be between 0.01 and 0.1).

In addition, the alkaline medium (caustic soda for example) used in this oxidation stage should be in sufficient quantity to keep the pH of the pulp to be treated to a value of 9 to 12, and preferably 10 to 11, in order to cause a swelling of the cellulose fibres of the pulp and to make the lignin adsorbed on the surface of the said cellulose fibres or embedded in the pores of said fibres, more accessible to the action of the peroxides, which action results in an oxidation and in fragmentation of the lignin into smaller molecules which can be eliminated from the system by solubilization.

The advantages given by the present process are many: the dissolved material contained in the recycling effluents being partly constituted by carboxylic acid salts (oxidized lignin) with a buffer effect, it is now no longer necessary to use inorganic buffers and/or cellulose preservatives (and in particular no sodium silicate or magnesium sulfate,) in the peroxide oxidation stage. Moreover, the mechanical pressing affords a better extraction and a better elimination of the oxidized lignins and of the other dissolved materials, and consequently, it is possible to obtain a reduction of the pollution rejected during the final bleaching phases greater than the reduction to be expected from a simple peroxide delignification.

It is preferable not to press the pulp immediately after the reagents are added but rather to let these act and to do the pressing at the end of the oxidation after retention; pressing of the high density pulp with a view to obtaining an extraction after oxidation with alkaline peroxides gives results that are considerably better than those obtained with by squeezing means intended to help the impregnation, and it permits to substantially reduce the rejected pollution.

The pressing can be performed by any known means provided that a high pulp concentration is obtained, of the order of 30% or more if possible, for example with presses or wash-presses.

Such a process applies to chemical pulp in general, whether or not they are produced by an alkaline process (for example the Kraft process) or by an acid process (bisulphite processes).

It is also a thermal energy preserving process and the pressing of the pulp makes it possible to recover, not only a large quantity of filtrates but also the therms of those filtrates. The surplus of filtrates can thus, not only be recycled at the oxidation phase, but also be used for washing the pulp above the oxidation stage, i.e. after the cooking. This is an additional advantage over the conventional processes, in which the pulp resulting from the peroxide treatment is simply washed with water and the effluents, once diluted, are directly subjected to an evaporation and to a concentration of dissolved materials before being burnt. The absence of pressing therefore does not permit, in such a case, to obtain the optimum gain of extraction and of pollution; the absence of recycling does not permit a protection of the pump and a saving of the chemical products and of therms.

According to another characteristic of the invention, the mechanical pressing is effected so as to obtain an expression of the oxydated pulp which corresponds to a pulp concentration (or density) of 10 to 60%, and preferably 30 to 40%.

Moreover, the prior dilution of the oxidized pulp before the pressing is controlled so that a pulp concentration of 1 to 5% is obtained immediately before pressing.

In the same way, the recycling of part of the extraction effluents of the pressing stage above the oxidation stage, is controlled so as to obtain a proportion of dissolved materials of 0.5 to 5% by weight with respect to the pulp.

Moreover, the juices contained in the pulp are preferably moved by washing liquor, immediately after the pressing.

According to yet another characteristic of the invention, the oxidation stage of the unbleached pulp is conducted with hydrogen peroxide in the presence of caustic soda.

The temperature in the oxidation stage may vary between 40° and 95° C., and preferably between 70° and 90° C.

Moreover, the oxidation stage lasts between 10 mins. and 5 hours, and preferably between 20 mins. and 3 hours.

And in addition, the peroxide/added NaOH weight ratio may vary between 0.1 and 0.8 and preferably between 0.4 and 0.6.

According to another characteristic of the invention, the oxidized, pressed and possibly washed pulp is subjected to a series of subsequent bleaching operations.

Also, during the peroxide oxidation stage, the inventors have noted that when said oxidation is conducted in a sealed enclosure (closed oxidation reactor, i.e. not opened to the atmosphere) a slight overpressure develops in the column of pulp compared with the pressure of the steam of the liquid phase of the pulp, probably because of the formation of very active nascent oxygen and that, in these conditions, the rat of delignification of the pulp is significantly improved.

Thus according to a new characteristic of the invention, a slight overpressure is maintained in the pulp column, at the peroxide oxidation stage, compared with the atmospheric pressure and with the pressure of the steam in the liquid phase of the pulp to be treated.

Such an overpressure is limited to a value which is below or equal to 2 $Kg/cm^2$.

Said overpressure in the pulp column may be advantageously maintained by closing the reactor and by the hydraulic pressure of the column of pulp in the case of an upwards flow.

To carry into effect the improvement according to the invention, the peroxide oxidation stage is conducted in a closed reactor inside which the pulp moves either down or upwards.

The invention is illustrated by the following non-limitative examples.

Figure 2:
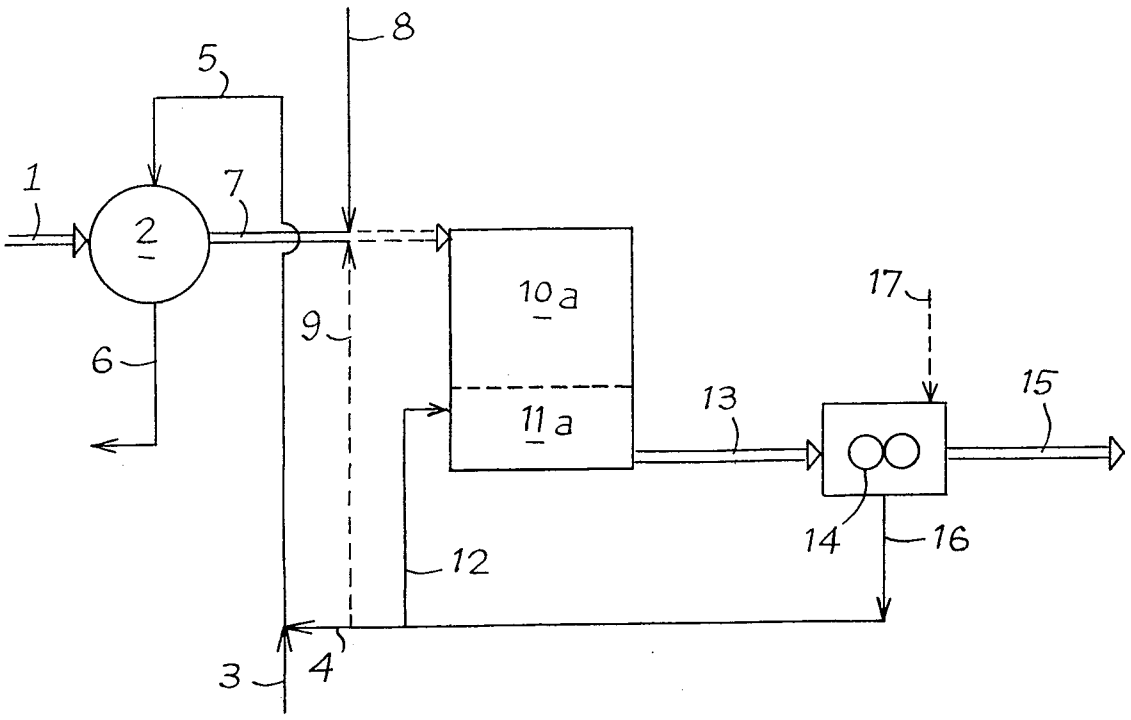
Figure 3:
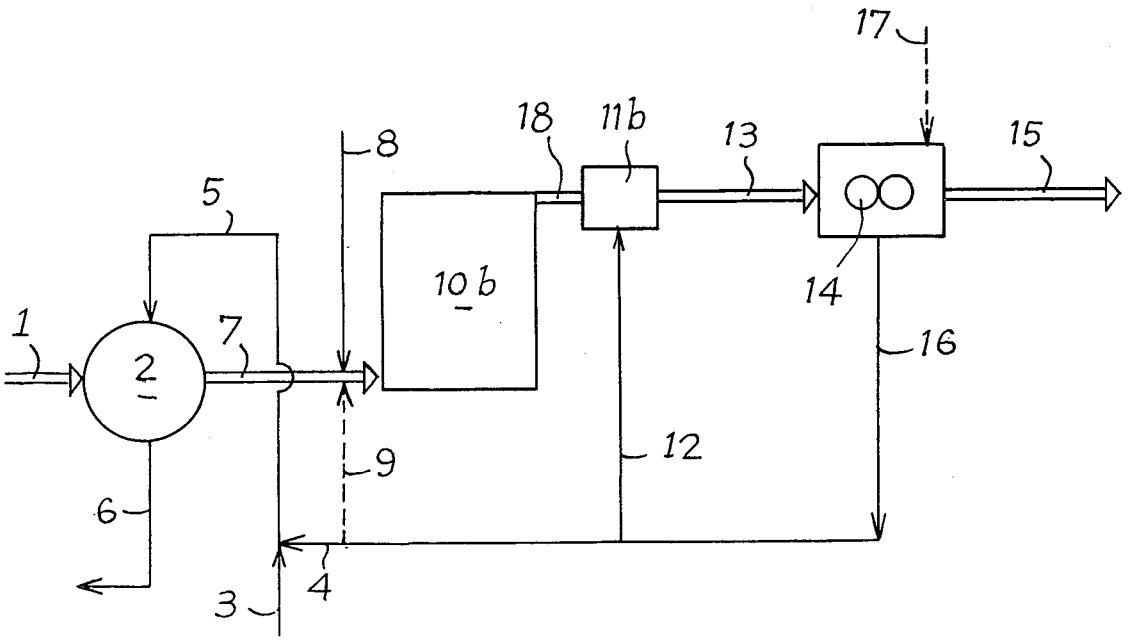

The process according to the invention can be carried out in an installation such as diagrammatically shown in FIG. 1 of the drawing. FIGS. 2 and 3 show variants of the installation of FIG. 1 using a downwards flow tower with opened oxidation reactor (FIG. 2) an upwards flow tower with closed oxidation reactor (FIG. 3) respectively.

EXAMPLE 1

An (unbleached) Kraft hardwood (birch or oak trees) pulp of Kappa index 19.5 is oxidized with hydrogen peroxide:

first, according to the process in the invention , and second, for comparison, according to an oxidation process with hydrogen peroxide in an alkaline medium without pressing.

The process of the invention is conducted in the installation diagrammatically illustrated in FIG. 1 of the drawing.

Wash

The unbleached pulp (1 ton) from the cooking and containing 4.5 t of residual liquor is introduced through the pipe 1 in the last washing zone supplied with a mixture of water (4 tons) brought through pipe 3 and of part of the pressing effluent (2.5 t) brought through the pipe 4, via the supply pipe 5. The water and the pressing effluent have a temperature of 65° C. 6.5 tons of a washing effluent are sent to the first stage of wash and/or for recovery (by combustion) through the pipe 6.

Oxidation

The pulp washed coming out from the wash zone through the pipe 7 and containing 4.5 tons of a mixture of water and pressing effluent, simultaneously receives:

first, the hydrogen peroxide oxidation reagents (0.005 t) and caustic soda (0.005 t) and their dilution water (0.01 t) coming from the pipe 8, and second, another part of the pressing effluent (4.5 t) brought through the pipe 9.

The mixture consisting of pulp, reagents, and pressing effluent, penetrates into the oxidation reactor 10 to undergo an oxidation reaction (temperature 70° C., time 2 hrs).

Dilution

The oxidized mixture then goes through a dilution zone 11 to receive therein another part of the pressing effluent (15 t) brought through the pipe 12.

Pressing

The oxidized and dilute pulp coming out of the dilution zone through the pipe 13 and containing 24 tons of a mixture of water and pressing effluent is sent into a press 14 and expressed to a pulp concentration of 32.9%. A delignified pulp of 32.9% concentration is obtained at the press outlet through the pipe 15 (i.e. 2 t of liquid per t of pulp).

Recycling

Furthermore, a pressing effluent (22 t) is recycled through the pipe 16:

first, at the inlet to the oxidation reactor (4.5 t), second, in the dilution zone (15 t), and also in the washing zone (2.5 t).

The results of the test are given in Table I. They show that, in the conditions adjusted so as to obtain the same rate of delignification (Kappa index) and the same pulp quality (D.P.), it is possible with the process according to the invention, owing to the mechanical pressing of the pulp after oxidation and to the recycling of the pressing effluent above and below the oxidation reactor and even towards the zone where the unbleached pulp is washed, to save substantially on the consumption of oxidation reagents (the consumption is reduced by half compared with the control test with no pressing), and on the consumption of heat energy (consumption approximately reduced by half compared with the control test);

TABLE I

| | Control Test without pressing | Process of the invention with pressing and recycling |
|---|---|---|
| Total Quantity of water introduced (including wash before oxidation t/tp* | 6.5 | 4.0 |
| Water temperature °C. | 60 | 65 |
| Pulp concentration after wash and before oxidation | 18 | 18 |
| Pulp concentration just before oxidation (after 1st dilution) | 10 | 10 |
| % $H_2O_2$ introduced | 1 | 0.5 |
| % NaOH introduced | 1.0 | 0.5 |
| Temperature °C. | 70 | 70 |
| Duration of retention | 2 hrs. | 2 hrs. |
| Oxidation juice recycling: | | |
| wash before reactor t/tp | 0 | 6.5 |
| Dilution at reactor inlet t/tp | 0 | 4.5 |
| Dilution at reactor outlet t/tp | 0 | 15.0 |
| M.S.** reactor inlet kg/tp | 0 | 24 |
| pH | 10.5 | 10.5 |
| % Pulp concentration after pressing | 12 | 32.9 |
| Therms consumed /tp | 440 | 240 |
| Chemical reagents costs FF/tp | 42 | 23.5 |
| Kappa Index | 13.2 | 13.4 |
| D.P. (Degree of polymerization | 1100 | 1100 |

*t/tp = Ton per ton of pulp
**M.S. = dissolved materials

EXAMPLE 2

The same (unbleached) hardwood Kraft pulp with a Kappa index of 19.5 is treated according to the process of the invention, with 1% $H_2O_2$, and according to conventional delignification process using oxygen under pressure. The results given in Table II show that the process according to the invention makes it possible, when working with no pressure and at a lower temperature, to obtain the same results as with the oxygen process (requiring pressurized reactors which are expensive and difficult to handle).

TABLE II

| | Control Test Bleaching with pressurized oxygen | Bleaching with peroxide after pressing as per the invention |
|---|---|---|
| % dissolved material with respect to the pulp at reactor inlet (*) | 2.5 | 2.5 |
| Temperature, °C. | 115 | 95 |

TABLE II-continued

| | Control Test Bleaching with pressurized oxygen | Bleaching with peroxide after pressing as per the invention |
|---|---|---|
| Pressure $0_2$ (bars) | 7 | 1 |
| % NaOH | 1.4 | 1.8 |
| % $H_2O_2$ | 0 | 1 |
| % pulp concentration at reactor inlet | 27 | 10 |
| Time of retention | 45 mins. | 2 hrs. |
| % pulp concentration at reactor outlet (dilution) | 5 | 2 |
| % pulp concentration after Squeezing or pressing | 10 | 33 |
| Kappa index | 12 | 12.3 |
| D.P. | 900 | 910 |

(*)oxidation filtrates recycled before the oxidation stage in the 2 processes)

EXAMPLE 3

An unbleached Kraft pulp from various hardwoods (oak or birch tree) with a Kappa index of 19.4 is delignified according to the process of the invention, with pressing followed by a wash, and recycling, and according to a control test of peroxide bleaching with simple spin drying, and no recycling.

The following results show that the pressing/wash according to the invention permits a gain of delignification in view of the control test, with half less caustic soda, for a short retention time, and less wash water.

| | Control Test with peroxide no pressing | Process of the invention Peroxide + wash-press |
|---|---|---|
| Recycling | 0 | 2 |
| % dissolved material/pulp | | |
| % NaOH/pulp | 1.2 | 0.6 |
| % $H_2O_2$/pulp | 0.5 | 0.5 |
| T°, °C. | 80 | 80 |
| Retention time (min.) | 20 | 20 |
| % Dilution concentration | 1 | 1 |
| % Pressing | 10 | 35 |
| Wash water (*) t/tp (press outlet) | 11 | 4 |
| % delignification | 19 | 24 |

(*) The wash water (4t) is introduced at the press outlet through the pipe 17 of FIG. 1 (and no longer through the pipe 4 at the inlet to the wash area 2).

EXAMPLE 4

An (unbleached) Kraft hardwood (birch/oak trees and others) pulp of Kappa index 17, is treated according to the process of FIG. 1, in the following conditions:

| | |
|---|---|
| % $H_2O_2$/pulp = | 0.25 |
| Alkali pulp (in % NaOH/pulp) = | 0.4 |
| Temperature = | 70° C. |
| Time = | 2 hrs. |
| Pulp concentration (reactor inlet) = | 10% |
| Dissolved materials (pressing filtrates) recycled at reactor inlet. (% dissolved materials/pulp = | 1.0 |
| Dissolved materials (Kraft cooking liquors entering the reactor with the pulp. % = | 1.0 |
| Pulp concentration (dilution zone) = | 1.4% |
| Pulp concentration after pressing = | 33% |

The Kappa index obtained after pressing is 13.

The pulp treated this way and the untreated (control) pulp are bleached according to a conventional sequence of total bleaching $CEDE_HD$ in the conditions given in Table III (C=chlorination; E=alkaline extraction; D=treatment with chlorine dioxide; $E_H$=extraction with hypochlorite in alkaline medium).

Besides, the saving in chemical produces and in thermal energy (temperature), important gains are noted on the pollution. These gains are further increased if, during the pressing phase, the juices contained in the pulp are moved by a washing juice (hot water) by way for example of a wash-press (Test 2) through wash.

The mechanical properties as well as the optical properties (whiteness and whiteness stability) of the pulp are also improved.

TABLE III

| | Preoxidized & pressed pulp 1 | | Preoxidized pressed & washed Pulp 2 | | Control Test (normal bleaching) 3 | |
|---|---|---|---|---|---|---|
| Dissolved residual Materials | 0.6 | | 0 | | 1.5 | |
| % diss. mat./pulp | | | | | | |
| C* (20 mins, 20° C.) | | | | | | |
| % $Cl_2$ introduced | 3.2 | | 2.9 | | 4.2 | |
| % $Cl_2$ residual | 0.55 | | 0.5 | | 0.46 | |
| E (1 h 25 mins) | 55 | | 55 | | 60 | |
| Temperature (°C.) | | | | | | |
| % NaOH introduced | 1.2 | | 1.1 | | 1.3 | |
| pH | 11.3 | | 11.2 | | 11.4 | |
| $D_1$ (2 h 15 mins, 70° C.) | 1.2 | | 1.2 | | 1.4 | |
| % $ClO_2$ introduced | | | | | | |
| $E_H$ (1 h) | 55 | | 55 | | 55 | |
| Temperature (°C.) | | | | | | |
| % NaOH | 0.6 | | 0.6 | | 0.25 | |
| % Na hypochlorite (as active C12) | 0 | | 0 | | 0.6 | |
| $D_2$ (3 h 40 mins, 80° C.) | 0.4 | | 0.4 | | 0.6 | |
| % $ClO_2$ introduced | | | | | | |
| Whiteness | 90 | | 90.1 | | 89.7 | |
| % Yield | 96.8 | | 96.8 | | 96.2 | |
| D.P. | 940 | | 950 | | 850 | |
| Whiteness stability** | 3.4 | | 3.4 | | 4.2 | |
| Mechanical Characteristics**** | | | | | | |
| Refining time (Jokro) min | 0 | 32 | 0 | 32 | 0 | 25 |
| °SR (Schopper Riegler) | 16 | 40 | 16 | 40 | 15 | 40 |
| Breaking length (m) | 1.8 | 6.4 | 1.8 | 6.3 | 1.6 | 6.1 |
| % Stretch | 1.7 | 3.7 | 1.7 | 3.7 | 1.6 | 3.3 |
| Tearing Index (D)*** | 509 | 777 | 510 | 775 | 427 | 749 |
| Bursting | 0.8 | 3.9 | 0.8 | 3.9 | 0.7 | 3.6 |
| Featherweight paper | 1.84 | 1.30 | 1.85 | 1.30 | 1.93 | 1.30 |
| Porosity | 78.9 | 7.4 | 78.9 | 6.5 | 78.9 | 5.7 |
| Pollution | | | | | | |
| Color kg Pt/t Commercial pulp | 41 | | 30 | | 66 | |
| DCO $kgO_2$/t Commercial Pulp | 14 | | 10 | | 33 | |

*C = chlorination; E = Alkaline extraction; $D_1$ = 1st stage of treatment with chlorine dioxide; $D_2$ = 2nd stage with chlorine dioxide: $E_H$ = extraction in the presence of hypochlorite).

**Whiteness stability = loss of white with ageing in severe conditions: 1 hr at 100° C., at 100% relative humidity.

***Tearing index expressed in millinewton per g/m2.

****The mechanical characteristics are measured according to the following norms: featherweight = NF Q03017; permeability = NF Q03 001; breaking length = NF Q03 004; bursting = NF Q03 014; tearing = NF Q03 011; whiteness = NF Q03 008 (or ISO).

EXAMPLE 5

The pulp of Example 3 is preoxidized in the conditions indicated in Table IV, then bleached to a high level of whiteness, limiting the number of stages to 4 according to a sequences CEHD and CEPD, (the 1st stage of treatment with chlorine dioxide is eliminated). Table IV shows that with the preoxidation according to the process of the invention it is possible to reach a higher quality of pulp than with a conventional bleaching process $CEDE_HD$.

TABLE IV

| | Pulp preoxidized according to the invention | | Control Test (normal bleaching) |
|---|---|---|---|
| | Preoxidation conditions Time = 2 h Temperature = 70° C. Pulp concentration after pressing = 30% % $H_2O_2$ introduced = 0.3 % NaOH introduced = 0.5 pH = 11.2 | | |
| Dissolved residual materials | 0.6 | | 1.5 |
| % diss. mat./pulp | | | |
| C | | | |
| Time | 30 mins. | | 20 mins. |
| Temperature, °C. | 40 | | 20 |
| % $Cl_2$ introduced | 3.3 | | 4.2 |
| % uree introduced | 0.1 | | 0 |
| % $Cl_2$ residual | 0.52 | | 0.44 |
| E | | | |
| Time | 2 h 15 mins | | 1 h 25 mins |
| Temperature, °C. | 50 | | 60 |
| % NaOH | 1.2 | | 1.3 |
| pH | 11.4 | | 11.4 |
| $D_1$ | | | |
| (2 h 15 mn, 70° C.) | | | |
| % $ClO_2$ introduit | | | 1.4 |
| $E_H$ ou $E_P$* | | | |
| Time | 2 h 45 mins | 2 h 45 mins | 1 h |
| Temperature, °C. | 60 | 40 | 70 |
| % NaOH | 0.8 | 0.9 | 0.25 |
| % $H_2O_2$ | 0.75 | 0 | 0 |
| % NaOCl (as active $Cl_2$) | 0 | 1.5 | 0.6 |
| $D_2$ | | | |
| Time | 4 h | 4 h | 3 h 40 mins |
| Temperature, °C. | 80 | 80 | 80 |
| % $ClO_2$ introduced | 0.9 | 0.8 | 0.4 |
| % Yield | 96.9 | 96.3 | 96.2 |
| Whiteness | 89.8 | 89.9 | 89.7 |
| D.P. | 985 | 970 | 850 |
| Color effluents kg Pt/t commercial pulp | 34 | 34 | 66 |

*$E_P$ = extraction by peroxide

EXAMPLE 6

A Kraft pulp from various hardwoods (birch or oak trees for example) preoxidized according to the invention and the same pulp, untreated, are bleached conventionally according to a DEDED sequence. Table V shows that same pulp preoxidized in the conditions indicated may be entirely bleached with a bleaching sequence reduced to 3 stages $C_DHD$ (elimination of 2 normal stages). Also to be noted is the important gain thus achieved over the pollution (color) of the rejected effluents.

TABLE V

| | Pulp preoxidized according to the invention | Control Test |
|---|---|---|
| | Preoxydation: Pulp concentration = 10% % $H_2O_2$/Pulp = 0.5 % NaOH/Pulp = 0.6 Recycled dissolved materials/pulp = 2 Time = 2 h T° = 70° C. Dilution 5 mins at 4% pulp concentration Pressing to 35% pulp concentration | Normal Bleaching |
| Wash: Residual dissolved materials at start of chlorination | 0 | 0 |
| C | | |
| % $ClO_2$ | 0.5 | 0 |
| % $ClO_2$ | 3.1 | 4.5 |
| Temperature, °C. | 40 | 20 |
| Time | 30 mins | 20 mins |
| E ou H | | |
| % NaOH | 1.3 | 1.3 |
| % hypochlorite | 1.8 | 0 |
| Temperature, °C. | 50 | 50 |
| Time | 1 h | 1 h 25 mins |
| pH | 11.8 | 11.6 |
| D | | |
| % $ClO_2$ | 0.8 | 1.2 |
| Tmperature, °C. | 78 | 70 |
| Time | 3 h 40 mins | 2 h 17 mins |
| E | | |
| % NaOH | — | 0.6 |
| % hypochlorite | — | 0.5 |
| Temperature, °C. | — | 56 |
| Time | — | 1 h |
| D | | |
| % $ClO_2$ | — | 0.6 |
| Temperature, °C. | — | 78 |
| Time | — | 3 h 40 mins |
| Whiteness | 91 | 90.5 |
| Pollution (color) kg Pt/tpbAD | 9 | 74 |

EXAMPLE 7

A hardwood (Birch tree/oak tree) pulp prepared according to the cooking process using sodium bisulphite and having a Kappa Index of 20.2 is preoxidized according to the process of the invention and bleached to a high level of whiteness. The results of Table VI shows the advantages of the process compared with the DEHD sequence normally used for a bisulphitic pulp (whiteness, cleanliness, consumption of chemicals).

TABLE VI

| | Conventional Process | Process of the Invention |
|---|---|---|
| Preoxydation | DEHD | P × DEHD |
| Time | | 2 h 30 mins |
| Temperature, °C. | | 90 |
| % Pulp concenration | | 10 |
| % NaOH | | 2 |
| % $H_2O_2$ | | 0.5 |
| % Residual | | 0 |
| Kappa | | 11 |
| D/C | | |
| Temperature, °C. | 40 | 40 |
| Time | 30 mins | 30 mins |
| % Pulp concentration | 3.5 | 3.5 |
| % $ClO_2Cl_2$ | 1.4 | 0.9 |
| % Residual | 0.1 | 0.20 |
| pH | 3.4 | 4.4 |

TABLE VI-continued

| | Conventional Process | | Process of the Invention |
|---|---|---|---|
| E | | | |
| % Pulp concentration | 3.5 | | 3.5 |
| Temperature, °C. | 50 | | 50 |
| Time | 40 mins | | 40 mins |
| pH | 10.9 | | 11.5 |
| % NaOH | 1.0 | | 1.0 |
| H | | | |
| % Pulp concentration | 6 | | 6 |
| Temperature, °C. | 50 | | 50 |
| Time | 3 h 30 mins | | 3 h 30 mins |
| % hypochlorite | 1.5 | 2.0 | 1.5 |
| % NaOH | 0.6 | 0.6 | 0.6 |
| % Residual | 0.07 | 0.17 | 0.12 |
| pH | 10.6 | 10.6 | 11.5 |
| D | | | |
| Temperature, °C. | 85 | 85 | 85 |
| Time | 2 h | | 2 H |
| % $ClO_2$ | 0.7 | 0.7 | 0.8 |
| % Residual | 0.14 | 0.23 | 0.20 |
| pH | 2.9 | 2.9 | 3.2 |
| Whiteness | 87.8 | 88.2 | 91.2 |
| Cleanliness** | 230 | 190 | 160 |

*preoxydation
**Number of black spots/100 g.

EXAMPLE 8

This example shows the advantage of the pressing after the peroxide treatment, according to the invention.

A Kraft hardwood pulp with a Kappa index of 19.4 is oxidized with peroxide and then pressed according to the process of the invention (P+Press).

Conditions of the treatment with hydrogen peroxide (P)

Pulp concentration: 10%

T° C.: 80

Time: 20 mins.

Conditions of the pressing (Press)

Dilution of pulp before pressing at a pulp concentration of: 4%

Retention of the pulp concentration of 4% 15 mins.

Pressing to pulp concentration: 37%

Wash by displacement during passage, dilution factor: 2 t water/tp

Temperature wash water: 65° C.

By way of comparative tests: the pulp is first subjected to a pressing, then to an oxidation with peroxide (Press+P); in another test, the pulp is subjected to only a pressing, with no oxidation (Press only); the results are given in Table VII.

TABLE VII

| Combination | Press + P | P + press | Press only |
|---|---|---|---|
| Final Kappa Index | 14.3 | 14.5 | 19.5 |
| % NaOH | 1.2 | 0.6 | — |
| % $H_2O_2$ | 0.5 | 0.3 | — |
| % Recycled dissolved materials at start of stage P | — | 2.5 | — |
| Therms/tp | 450 | 200 | — |
| % Materials dissolved on pulp after treatment | 2.5* | 0.6 | 0.4 |
| Pollution of the effluent of final bleaching CEDED (Color Pt/t commercial pulp) | 60 | 40 | 55 |

*after wash on filter

Only the process according to the invention has permitted to make a considerable economy in the consumption of reagents, of heat energy and a great reduction of the pollution.

EXAMPLE 9

An (unbleached) Kraft hardwood (birch, oak tree . . . ) pulp with a Kappa index of 20.5 oxidized with hydrogen peroxide:

first, according to the process of the invention, and second, for comparison, according to the oxidation process using hydrogen peroxide in alkaline medium in descending tower with opened reactor.

The process according to the invention is carried out in the installation diagrammatically illustrated in FIG. 2 of the drawing.

Washing

The unbleached pulp obtained from the cooking and containing the residual liquor is introduced through pipe 1 in the last washing zone 2 which is supplied with a mixture of water brought through the pipe 3 and of pressing effluent brought through the pipe 4, via the supply pipe 5. The water and pressing effluent have a temperature of 95° C. A washing effluent is sent at the first washing stage and/or at recovery (by combustion) through the pipe 6.

Oxidation

The washed pulp obtained from the washing zone through the pipe 7 and containing a mixture of water and pressing effluent receives simultaneously:

first, the hydrogen peroxide and caustic soda oxidation reagents and their dilution water coming through the pipe 8, and second, another part of the pressing effluents brought through the pipe 9.

The mixture consisting of pulp, reagents and pressing effluent, enters a downwards flow tower, at the top part of an oxidation reactor 10*a*, of the closed type, to undergo an oxidation reaction. The said mixture progresses downwards from the top inside the said reactor. A slight overpressure of 300 g/cm2 is kept in the column of pulp. This is probably due to the formation of nascent oxygen through decomposition of the hydrogen peroxide in the conditions in which the process is carried out.

Dilution

The oxidized mixture then goes into a dilution zone 11*a* provided in extension of the lower part of the reactor 10*a* to receive therein another part of the pressing effluent brought through the pipe 12. The reactor-dilution zone assembly constitutes a descending tower with closed reactor.

Pressing

The oxidized and diluted pulp obtained from the lower part of the dilution zone through the pipe 13 and containing a mixture of water and pressing effluent is sent into a press 14 and expressed to a pulp concentration of 33%. The delignified pulp with a 33% concentration is obtained at the outlet of the press through the pipe 15.

Recycling

Moreover, a pressing effluent is recycled through the pipe 16:

first, at the inlet to the oxidation reactor (through the pipe 9)

second, into the dilution zone (through the pipe 12) and also into the washing zone (through the pipe 4).

The washing water can also be introduced at the outlet of the press through the pipe 17 (instead of through the pipe 4 at the inlet of the washing zone 2).

The results of the test are given in Table VIII. They show that in the conditions recommended according to the invention (oxidation with hydrogen peroxide in downwards flow tower with closed reactor, with a slight overpressure of 300 g/m2 the rate of delignification obtained corresponds to a final Kappa index of 9.6 against a final Kappa index 12.1 when operating under identical experimental conditions but in an open reactor (atmospheric pressure), i.e. a significant improvement of the said rate of delignification.

TABLE VIII

| Kraft Pulp (Hardwood) | | |
|---|---|---|
| Kappa Index of unbleached pulp | 20.5 | |
| % recycled dissolved materials/Pulp | 8 | |
| Oxidation: | | |
| Temperature °C. | 95 | |
| Time | 120 mins. | |
| % $H_2O_2$/pulp | 1.5 | |
| % NaOH/pulp | 1.8 | |
| Final pH | 11 | |
| % pulp concentration after pressing | 33% | |
| Developed Pressure | 0 open Reactor | 300 g/cm$^2$ closed Reactor |
| Final Kappa Index | 12.1 | 9.6 |

EXAMPLE 10

The process of the invention is carried out in the installation illustrated in FIG. 3. Such an installation comprises a upwards flow tower with closed reactor 10*b*, and separated dilution zone 11*b*. The remaining part of the installation is identical to that shown in FIG. 2.

The unbleached pulp to be treated is a Kraft softwood pulp with a Kappa index of 19.

Oxidation

The unbleached pulp obtained from the washing zone through the pipe 7 and containing:

on the one hand, the oxidation reagents (hydrogen peroxide and caustic soda) brought through the pipe 8, and on the other hand, part of the pressing effluent brought through the pipe 9, is introduced at the lower part of a closed upwards flow reactor 10*b* to undergo an oxidation reaction. The mixture rises upwards from the bottom inside the reactor as the oxidation reaction progresses. A slight over-pressure of 100 g/cm2 is kept in the column of pulp.

Dilution

The oxidized mixture is obtained at the top of the reactor through the pipe 18, and then goes through the dilution zone 11*b* to receive therein another part of the pressing effluent brought through the pipe 12.

The pressing of the oxidized and diluted pulp and the recycling of the pressing effluent are effected as described for the installation of FIG. 2.

A control test is also conducted under identical experimental conditions but in an open reactor. The results are given in Table IX. They show that, in the conditions recommended according to the invention (oxidation in upwards flow tower with closed reactor with a slight overpressure of 100 g/cm$^2$) a significant improvement of the rate of delignification of the pulp is obtained: indeed, the final Kappa index of the pulp obtained is 13.1 against a Kappa index of 15.1 for the control test conducted in an open reactor.

TABLE IX

| Kraft Pulp (softwood) | | |
|---|---|---|
| Kappa Index of unbleached pulp | 19 | |
| % Recycled dissolved materials/pulp | 0.7 | |
| Oxidation: | | |
| Temperature °C. | 90 | |
| Time min. | 120 | |
| % $H_2O_2$/pulp | 1 | |
| % NaOH/pulp | 2 | |
| Final pH | 12 | |
| Developed pressure | 0 | 100 g/cm$^2$ |
| | open Reactor | closed Reactor |
| Kappa Index | 15.1 | 13.1 |

What is claimed is:

1. A process for the delignification of unbleached Kraft pulp comprising the steps of:

washing the unbleached Kraft pulp;

diluting the washed pulp by the addition of part of the effluents extracted from the pressing step following the oxidation step to provide a quantity of dissolved materials of between 0.5% and 5% by weight with respect to the pulp;

treating the diluted unbleached Kraft pulp with a peroxide in an alkaline medium without using bleaching agents containing chlorine and without the addition of inorganic buffers or cellulose preservatives, to oxidize and fragment lignin molecules in the pulp, with a percentage ratio of peroxide with respect to the pulp per unit of Kappa index of said pulp between 0.01 and 0.1, with a pH between 10 and 12, at a temperature between 70° and 95° C., during a period of time between 20 minutes and 3 hours, while keeping during the oxidation step an autogenous overpressure slightly greater than atmospheric in the column of pulp by carrying out the reaction in a closed reactor, the overpressure in the column of pulp being limited to a value no greater than 2 Kg/cm$^2$;

diluting the oxidized pulp to a concentration of between 1 and 5% by weight;

pressing the diluted oxidized pulp mechanically to a consistency of 30% or more;

recycling a first portion of the effluents extracted from the pressing step to the dilution step prior to the treating step; and recycling a second portion of the effluents extracted from the pressing step downstream of the treating step for ensuring the dilution of the oxidized pulp before the pressing step.

2. The process of claim 1 wherein the overpressure in the column of pulp is limited to a value between 100 and 500 g/cm$^2$.

3. The process of claim 1 wherein the treating step is conducted in a closed reactor which the pulp progresses downwardly.

4. The process of claim 1 wherein the treating step is conducted in a closed reactor which the pulp progresses upwardly.

5. The process of claim 1, further including the step of recycling a third portion of the effluents extracted during the pressing step to the washing step.

6. The process of claim 1 wherein the pressing step produces a pulp concentration of between 30 and 60 percent.

7. The process of claim 1 wherein the juices contained in the pulp are removed by a washing liquor immediately after the pressing step.

8. The process of claim 1 wherein the treating step is conducted with hydrogen peroxide in the presence of sodium hydroxide.

9. The process of claim 1 wherein the pulp concentration after the pressing step is between 30 and 40 percent.

10. The process of claim 1 wherein the treating step is conducted at a temperature between 70° and 90° centigrade.

11. The process of claim 1 wherein the pH is kept at between 10 and 11 in the treating step.

12. The process of claim 1 wherein the treated pulp is subjected to a sequence of bleaching steps subsequent to the pressing step.

* * * * *

UNITED STATES PATENT AND TRADEMARK OFFICE

CERTIFICATE OF CORRECTION

PATENT NO. : 4,462,864

DATED : July 31, 1984

INVENTOR(S) : Jacques Carles and Henri Lemoyne

It is certified that error appears in the above—identified patent and that said Letters Patent is hereby corrected as shown below:

On the title page, item /73/ should read

-- Interox Societe Anonyme,

Brussels, Belgium --.

| | | |
|---|---|---|
| Column 2 | Line 18, | "between 0.01 and 0.01" should read --between 0.01 and 0.1-- |
| Column 2 | Line 27, | "adsorbed" should read --absorbed-- |
| Column 3 | Line 52, | "the rat of" should read --the rate of-- |
| Column 4 | Line 5, | New paragraph should start with --Figs. 2 and 3-- |
| Column 4 | Line 15, | "in the invention" should read --of the invention,-- |
| Column 4 | Line 55, | "dilute" should read --diluted-- |
| Column 6 | Line 62, | "materials/pulp =" should read --materials/pulp) = -- |
| Column 6 | Line 64, | "liquors" should read --liquors)-- |
| Column 7 | Line 8, | "produces" should read --products-- |
| Column 7 | Line 28- 29 | "E (1 h 25 mins) 55 55 60 Temperature (°C)" should read --E (1 h 25 mins) Temperature (°C) 55 55 60-- |

UNITED STATES PATENT AND TRADEMARK OFFICE

CERTIFICATE OF CORRECTION

PATENT NO. : 4,462,864

DATED : July 31, 1984

INVENTOR(S) : Jacques Carles and Henri Lemoyne

It is certified that error appears in the above—identified patent and that said Letters Patent is hereby corrected as shown below:

| | | |
|---|---|---|
| Column 7 | Line 32-33 | "$D_1$ (2 h 15 mins, 70°C) 1.2 1.2 1.4 % $ClO_2$ introduced" should read --$D_1$ (2 h 15 mins, 70°C) % $ClO_2$ introduced 1.2 1.2 1.4-- |
| Column 7 | Line 34-35 | "$E_H$ (1 h) 55 55 55 Temperature (°C)" should read --$E_H$ (1 h) Temperature (°C) 55 55 55-- |
| Column 7 | Line 37-38 | "$D_2$ (3 h 40 mins, 80°C) 0.4 0.4 0.6 % $ClO_2$ introduced" should read --$D_2$ (3 h 40 mins, 80°C) % $ClO_2$ introduced 0.4 0.4 0.6-- |
| Column 7 | Line 57, | "*C =" should read --* (C = -- |
| Column 8 | Line 8 | New paragraph should start with --Table IV shows-- |
| Column 8 | Line 21-22 | "% $H_2O_2$ introduced = pressing = 30%" should read -- pressing = 30% % $H_2O_2$ introduced = -- |
| Column 8 | Line 33, | "% uree" should read --% urée-- |
| Column 8 | Line 40, | "% $ClO_2$ introduit" should read --% $ClO_2$ introduced-- |
| Column 8 | Line 40, | "1.4" should read --1 4-- |
| Column 8 | Line 41, | $E_H$ ou $E_p$*" should read --$E_H$ or $E_p$*-- |

UNITED STATES PATENT AND TRADEMARK OFFICE

CERTIFICATE OF CORRECTION

PATENT NO. : 4,462,864

DATED : July 31, 1984

INVENTOR(S) : Jacques Carles and Henri Lemoyne

It is certified that error appears in the above-identified patent and that said Letters Patent are hereby corrected as shown below:

| | | |
|---|---|---|
| Column 9 | Line 23, | "E ou H" should read --E or H-- |
| Column 9 | Line 45, | "(Birch tree/" should read --(birch tree/-- |
| Column 9 | Line 50, | "shows" should read --show-- |
| Column 9 | Line 57 | "P x DEHD" should read --P * DEHD-- |
| Column 9 | Line 67, | "% $ClO_2$ $Cl_2$" should read --% $ClO_2$ in $Cl_2$-- |
| Column 10 | Line 18, | "2 h 2H" should read --2h 2h-- |
| Column 10 | Line 42, | "4% 15 mins." should read --4%: 15 min.-- |
| Column 10 | Line 55, | "Final Kappa Index 14.3" should read -- Final Kappa Index 14.5 --. |
| Column 12 | Line 12, | "300 g/m2" should read --300 g/$cm^2$)-- |

UNITED STATES PATENT AND TRADEMARK OFFICE

CERTIFICATE OF CORRECTION

PATENT NO. : 4,462,864

DATED : July 31, 1984

INVENTOR(S) : Jacques Carles and Henri Lemoyne

It is certified that error appears in the above—identified patent and that said Letters Patent is hereby corrected as shown below:

| | | |
|---|---|---|
| Column 12 | Line 13, | "index of 9.6" should read --index of 9.6,-- |
| Column 13 | Line 13 | "% Recycled dissolved 0.7" should read --% Recycled dissolved 0.5-- |

Signed and Sealed this

*Fifth* Day of *August 1986*

[SEAL]

*Attest:*

DONALD J. QUIGG

*Attesting Officer*

*Commissioner of Patents and Trademarks*